United States Patent [19]

Tiernan

[11] Patent Number: 4,792,056

[45] Date of Patent: Dec. 20, 1988

[54] DRUM AND CLOSURE APPARATUS

[75] Inventor: Martin J. Tiernan, Solon, Ohio

[73] Assignee: Drum Parts, Inc., Cleveland, Ohio

[21] Appl. No.: 123,200

[22] Filed: Nov. 20, 1987

[51] Int. Cl.[4] ..... B65D 45/32

[52] U.S. Cl. ..... 220/320

[58] Field of Search ..... 220/320, 319

[56] References Cited

U.S. PATENT DOCUMENTS

| | | | |
|---|---|---|---|
| 2,231,947 | 2/1941 | Rich | 220/320 |
| 3,028,993 | 4/1962 | Muhlhoff | 220/46 |
| 3,039,666 | 6/1962 | Carpenter | 229/5.7 |
| 4,135,657 | 1/1979 | Benson | 229/5.7 |
| 4,415,459 | 11/1983 | Coffman | 210/747 |
| 4,646,931 | 3/1987 | Andrews et al. | 220/320 |

FOREIGN PATENT DOCUMENTS

| | | | |
|---|---|---|---|
| 210815 | 8/1960 | Austria . | |
| 671772 | 10/1963 | Canada . | |
| 1198230 | 8/1965 | Fed. Rep. of Germany . | |
| 2397340 | 4/1979 | France . | |
| 174102 | 2/1958 | Sweden | 220/320 |

*Primary Examiner*—Joseph Man-Fu Moy

*Attorney, Agent, or Firm*—Fay, Sharpe, Beall, Fagan, Minnich & McKee

[57] ABSTRACT

A non-cylindrical container having sidewalls joined together by rounded corners is provided with an improved closure apparatus for more uniformly distributing closure forces around the periphery of the container and lid interface. The closure apparatus is formed from two bands which each consist of two leg portions joined by an included corner. The bands are selectively fastened together by a fastening means at their terminal ends which correspond to opposite rounded corners of the rectangular container. The leg portions of the bands may be inwardly concave allowing the sidewalls of the container to be preloaded in order to more uniformly distribute closure forces among the sidewalls and corners.

5 Claims, 3 Drawing Sheets

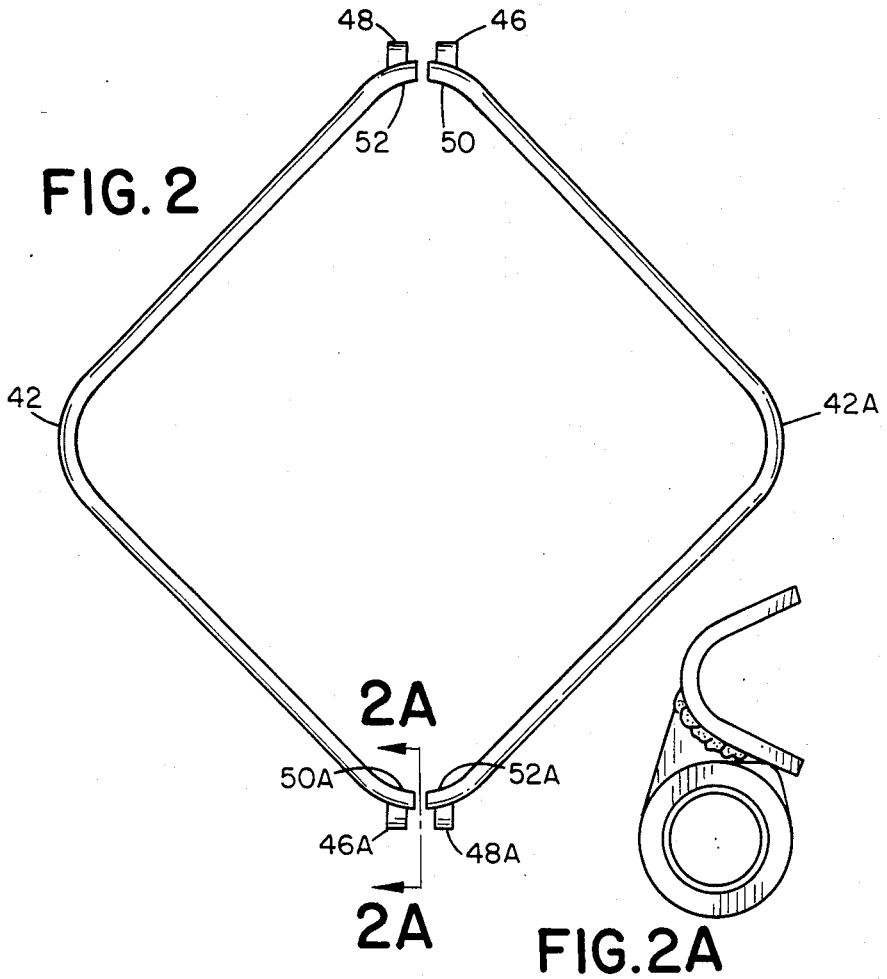
FIG. 2
FIG. 2A
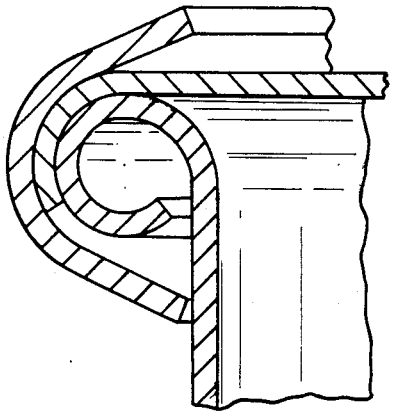
FIG. 3
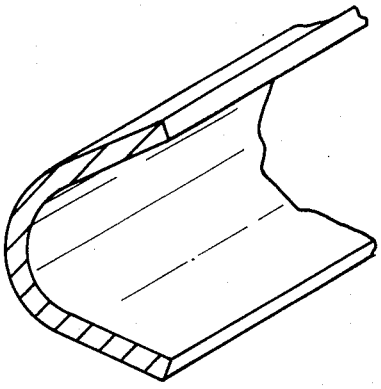
FIG. 4

DRUM AND CLOSURE APPARATUS

BACKGROUND OF THE INVENTION

This invention generally pertains to the storing of materials in rectangular containers and more particularly to means for closing such rectangular containers and storing them efficiently.

The invention is particularly applicable to rectangular drums requiring low leakage rates and will be described with particular reference thereto. However, it will be appreciated that the invention has broader applications such as the storing of non-toxic liquids and solids and may be advantageously employed in other environments and applications.

For many years, a cylindrical metal drum with associated lid has been a common container used for the storage and transportation of materials. Commonly referred to as "55 gallon drums", these containers need to be durable yet inexpensive and able to be securely closed. In recent years, the typical cylindrical design has begun to give way to a rectangular drum with rounded corners. The rectangular drums are more efficient since they can be packed closer together to store more material in the same space as an equivalent number of cylindrical drums.

While the rectangular drums offer space saving advantages, they have proven to be more difficult to securely close. Common closure devices used for circular drums enable tension to be applied uniformly around the top periphery of the drum and associated lid. However, the corners of a rectangular drum and lid tend to prohibit the uniform transmission of closure forces around the edge of the lid and associated container surface. Since containers must pass rigorous drop tests, so called because the drum is dropped from a specified height and then checked for spillage, and because rectangular drums are used for the storage of dangerous materials such as nuclear wastes, an effective means of closing and attaching the lid to an associated rectangular container is needed.

Closure methods for rectangular drums are well known in the prior art. For example, German Patent 1,198,230 issued to Reese discloses a method of uniformly applying tension to the entire periphery of the lid and container edges. A closure ring is shown which utilizes a hook and a lever to grippingly engage the surface of the lid and top surface of the container. The hook means and lever are located on one of the corners of the closure ring.

While this approach or variations of it overcome many of the drawbacks of previous designs, improvements are still desirable and needed. Although the fastening means is correctly placed on the corner of the drum and lid assembly, the tension forces generated in the closure ring are still not uniformly distributed over the periphery of the mating surfaces. It is believed that the corner opposite the lever and hook assembly will receive less tension than the other three corners. Further, the sides of the drum between corners will receive a proportionately lighter load of tension leading to potential spillage problems. Finally, the fastening means wastes valuable space when the drums are stacked together. The lever necessarily extends beyond the surface of the drum preventing the drums from being stacked closely together.

Consequently, a need exists for improvements in rectangular closure mechanisms which will result in more uniform distribution of closure forces over the periphery of the mating surfaces while retaining the storage efficiency inherent in rectangular storage containers.

The present invention provides a closure apparatus designed to satisfy the aforementioned needs.

SUMMARY OF THE INVENTION

The present invention contemplates a new and improved closure apparatus which overcomes all of the above referred problems and others and provides a container which is an expensive, efficient and not prone to spillage.

In accordance with the present invention, there is provided a closure apparatus for a generally rectangular container with a removable lid. The closure apparatus consists of two bands which grip the periphery of the container and container lid in such a way as to provide more uniform closing force. This is accomplished by locating the fastening means on opposite corners of the rectangular drum, thereby allowing the uniform transmission of closure forces along the entire periphery of the container and lid interface.

In accordance with a more limited aspect of the invention, the bands are designed in a way to preload the sidewalls of the container in order that they may share an appropriate amount of closure force with the corners of the container.

Further in accordance with the invention, the fastening means has been designed so that it does not prohibit dense packing of the containers for shipment. The fastening means allows the containers to be stacked contiguous with one another.

A principal advantage of the invention is a closure apparatus that more effectively seals rectangular containers and allows for efficient storage of the same.

Still another advantages and benefits of the invention will become apparent to those skilled in the art upon a reading and understanding of the following detailed description.

DETAILED DESCRIPTION OF THE DRAWINGS

FIG. 1 is a perspective view a rectangular container and closure apparatus in accordance with the present invention;

FIG. 1*a* is an enlarged view of the fastening means for the closure ring as shown in the perspective view of FIG. 1;

FIG. 2 is a plan view of the two bands that make up the closure apparatus;

FIG. 2*a* is an enlarged sectional view taken along line *2a—2a;*

FIG. 3 is an enlarged sectional view of the upper periphery of the container, the associated container lid and the closure apparatus in use;

FIG. 4 is a perspective sectional view of a band;

DETAILED DESCRIPTION OF THE PREFERRED EMBODIMENTS

Figure 1:
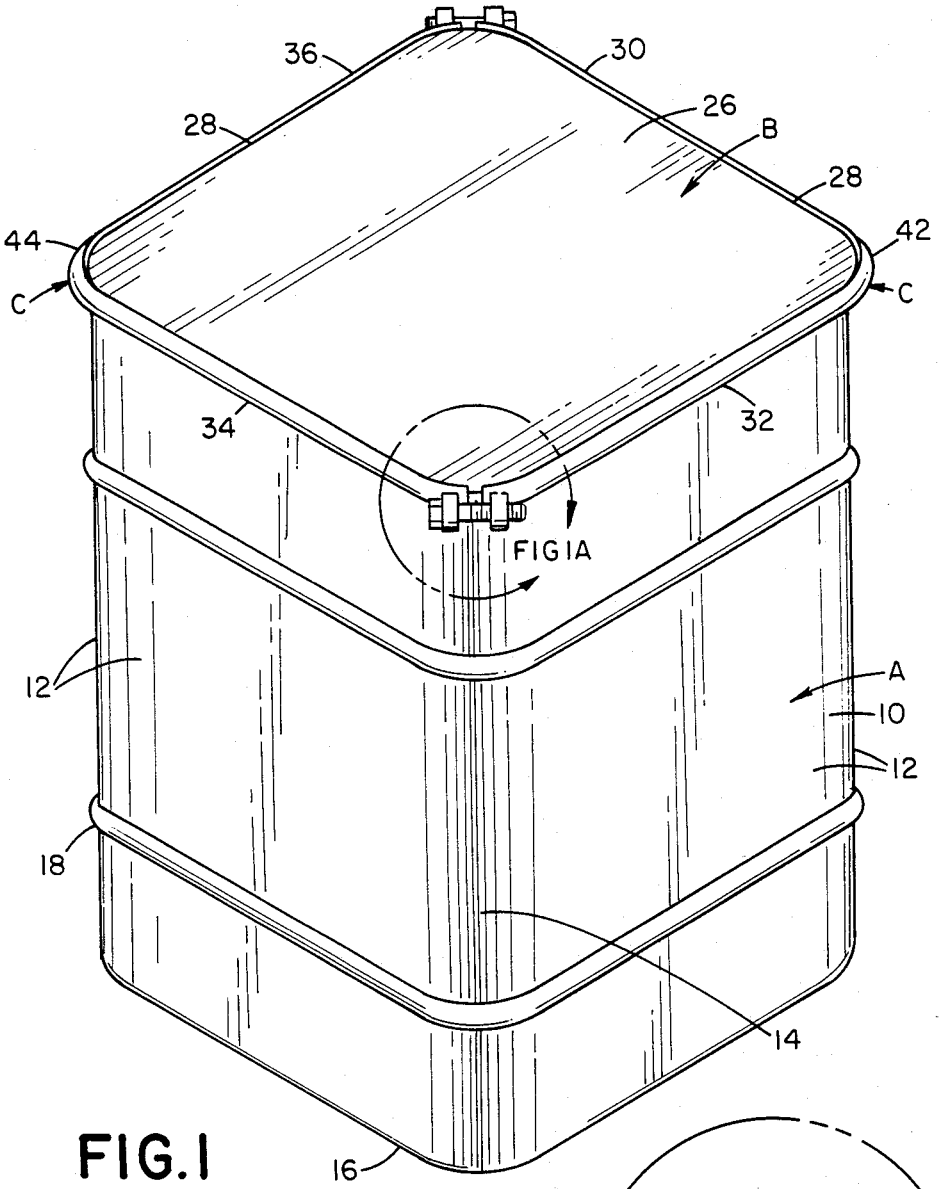
Figure 1A:
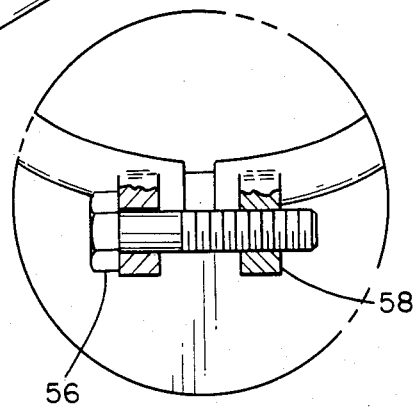

Referring now to the drawings wherein the showings are for the purposes of illustrating the preferred embodiment of the invention only and not for the purposes of limiting same, the figures show a rectangular container A with associated lid B and two bands C used to secure the lid B to the container A.

The container 10 is provided with four generally planar side walls disposed in a generally perpendicular relation, said sidewalls generally forming a hollow drum having a generally rectangular cross section. Each of the sidewalls is joined with the contiguous sidewalls by rounded corners. The lower power of each sidewall is joined with a bottom planar surface to form the bottom of the container. The base planar surface is joined with the edge of each sidewall along its periphery to form a leakage free enclosure. The sidewalls 12 are provided with rolling hoops 18 to protect the sidewalls 12 from damage during transport.

The container is provided with an associated lid 26 which selectively mates with the upper peripheral edges of the sidewalls 12. The lid 12 may be removed for filling or emptying the container and may be reattached to the container 10 for transporting.

The lid 26 is attached to container 10 by means of two bands 28. These bands have leg portions 30, 32, 34 and 36 which are disposed in a generally perpendicular relationship from each other and extend from and define an occluded, rounded corner 42 and 42*a*. Additionally, as can be seen in FIG. 2 the distal ends of each band 50, 50*a*, 52, 52*a* are turned inwardly at a 45° angle. When the bands are in operation, the 45° cooperates with the corresponding 45° angle on the other band to form a 90° corner similar to the included corners 42 and 42*a*.

The bands can be fastened together via a variety of fastening means known in the art. The preferred embodiment utilizes a collar 50 and 50*a* welded to one terminal end of each hand. At the other terminal end of each band a second collar having internal threads 52 and 52*a* is also welded. The bands are assembled in such a way that the non-threaded collar and the threaded collar are adjacent to each other and are aligned so that an appropriate fastening means, such as a threaded bolt 56 and nut 58 may secure the bands together.

Figure 5:
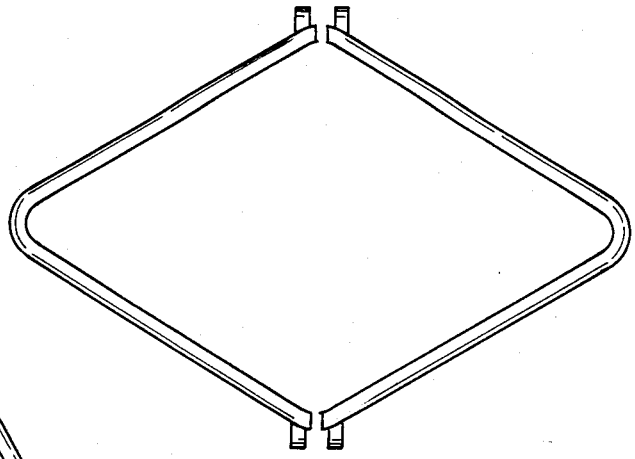
FIG. 5 is a plan view similar to FIG. 2 which shows a modification.
Figure 6:
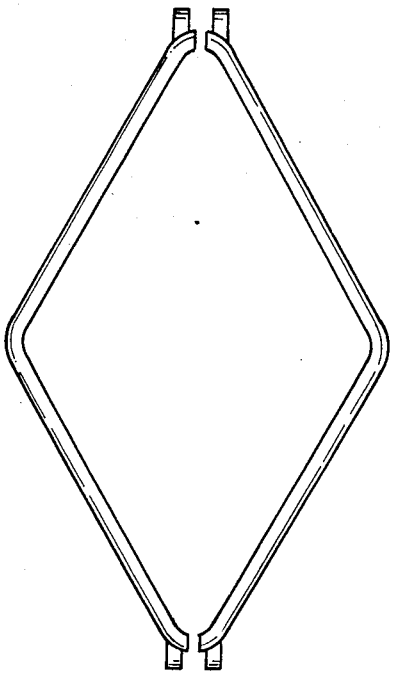
FIG. 6 is a plan view similar to FIG. 5 which shows a further modification.

Although the preferred embodiment utilizes a generally rectangular container 10 with generally 90° rounded corners 14, variations of the invention can be obtained by varying the shape of the container and associated bands as shown in Figure 5 and FIG. 6. The advantages obtained by the present invention will also be obtained with a non-rectangular container.

Figure 7:
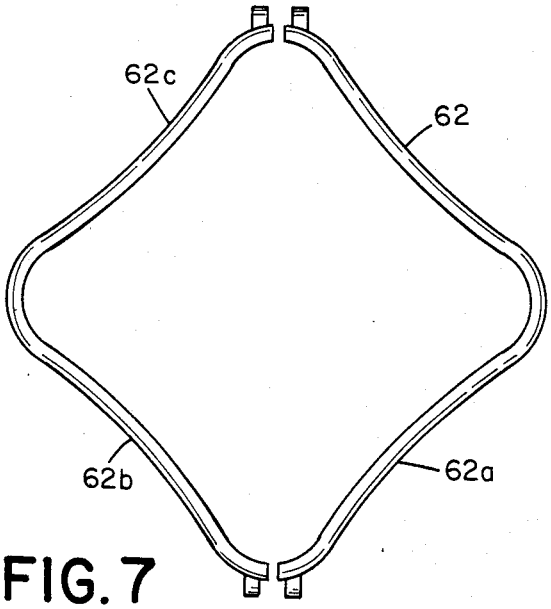
FIG. 7 is a plan view similar to FIG. 2 which shows a further modification.

A further modification of the invention is shown in FIG. 7. This modification features inwardly concave leg portions of the bands 62, 62*a*, 62*b*, 62*c*. These inwardly concave leg portions act to preload the sidewalls 12, 12*a*, 12*a*, 12*c* of the container and more evenly distribute closure forces between the sidewalls 12, 12*a*, 12*b*, 12*c* and the corners 14, 14*a*, 14*b*, 14*c* of the container.

The invention has been described with reference to the preferred embodiment. Obviously modifications and alterations will occur to others upon a reading and understanding of this specification. It is intended to include all such modifications and alterations insofar as they come within the scope of the appended claims or the equivalents thereof.

What is claimed is:

1. A closure apparatus for an associated generally rectangular container having rounded corners, the associated container having an associated removable lid to allow filling and emptying of the associated container, the associated lid having peripheral edges that selectively mate with peripheral edges on the associated container, said closure apparatus comprising:

first and second bands, each band having a first and second leg portion disposed in generally perpendicular relation and extending from and defining a first fully included rounded corner adapted for operative engagement with the peripheral edge of an associated container rounded corner, said first and second leg portion adapted for operative engagement with the peripheral edges of the associated container;

first and second outer ends defined at distal portions of respective first and second leg portions, said outer ends disposed angularly inward from its respective leg portion at an angle approximately 45° and in the same plane as said first and second leg portions, said ends defining approximately one-half of second and third rounded corners; and, means for selectively fastening said first and second bands together adapted to clampingly engage the associated container with the removable lid.

2. The apparatus as recited in claim 1 wherein the bands have a generally C-shaped cross-section.

3. The apparatus as recited in claim 1 wherein said first and second leg portions of each band form and define an obtuse angle.

4. The apparatus as recited in claim 1 wherein the first and second leg portions are inwardly concave toward the said peripheral edges of the container.

5. A rectangular container comprising:

a drum having four generally planar sidewalls disposed in generally perpendicular relation, each of said sidewalls joined with a contiguous sidewall by rounded corners, a bottom planar surface disposed at a base region of said sidewalls to define a generally rectangular inner cavity, a lid received at the upper region of said sidewalls for selectively closing said cavity;

means for selectively attaching said lid to said drum, said attaching means including first and second bands, each band having first and second leg portions disposed in generally perpendicular relation and having a predetermined dimension substantially equal to a sidewall dimension;

said first and second leg portions defining a first fully included rounded corner for operably engaging a selected first rounded corner of the drum, first and second outer ends defined at distal portions of respective first and second leg portions, said outer ends disposed angularly inward at an angle approximately 45° from its respective leg portion in the plane of the leg portions, said outer ends adapted to operably engaging approximately one half of selected second and third rounded corners of the drum contiguous to said drum first rounded corner;

and means for fastening said first and second bands together for clampingly engaging said lid to said drum.

* * * * *